US010969123B2

(12) United States Patent
Kraft et al.

(10) Patent No.: US 10,969,123 B2
(45) Date of Patent: Apr. 6, 2021

(54) CONTROL OF RESIDENTIAL HVAC EQUIPMENT FOR DEHUMIDIFICATION

(71) Applicant: Trane International Inc., Davidson, NC (US)

(72) Inventors: Wayne Kraft, Tyler, TX (US); Jason Thomas LeRoy, Tyler, TX (US); Roy Crawford, Blanchard, OK (US)

(73) Assignee: Trane International Inc., Davidson, NC (US)

( * ) Notice: Subject to any disclaimer, the term of this patent is extended or adjusted under 35 U.S.C. 154(b) by 69 days.

(21) Appl. No.: 15/816,956

(22) Filed: Nov. 17, 2017

(65) Prior Publication Data

US 2018/0142909 A1 May 24, 2018

Related U.S. Application Data

(60) Provisional application No. 62/424,174, filed on Nov. 18, 2016.

(51) Int. Cl.

| | |
|---|---|
| ***F24F 3/14*** | (2006.01) |
| ***F24F 3/153*** | (2006.01) |
| ***F24F 11/00*** | (2018.01) |

(52) U.S. Cl.

CPC ..... *F24F 3/14* (2013.01); *F24F 3/153* (2013.01); *F24F 11/0008* (2013.01); *F24F 2003/144* (2013.01)

(58) Field of Classification Search

CPC ..... F24F 11/0008; F24F 3/153; F24F 3/14; F24F 2003/144; F24F 2003/1446

USPC ..... 62/173, 176.5

See application file for complete search history.

(56) References Cited

U.S. PATENT DOCUMENTS 3,758,368 A * 9/1973 Trask ..... G05D 23/1912 165/228
4,813,474 A * 3/1989 Umezu ..... F24F 1/0003 165/228
5,353,862 A * 10/1994 Akiyama ..... F24F 3/14 165/229
5,752,389 A * 5/1998 Harper ..... F24F 3/153 62/176.5

(Continued)

FOREIGN PATENT DOCUMENTS

JP 2001201207 A * 7/2001 ..... F24F 3/153

OTHER PUBLICATIONS

International Code Council, Inc.; "2018 International Residential Code"; Chapter 15—Section M1505; Aug. 31, 2017; Retrieved from: https://codes.iccsafe.org/content/IRC2018/chapter-15-exhaust-systems#text-id-11681666; 3 pages.

*Primary Examiner* — Joel M Attey
*Assistant Examiner* — For K Ling
(74) *Attorney, Agent, or Firm* — Womble Bond Dickinson (US) LLP

(57) ABSTRACT

Systems and methods are disclosed that include providing a heating, ventilation, and/or air conditioning (HVAC) system with a system controller and an indoor air handling unit comprising an auxiliary heat source, whereby the system controller is configured to employ a hysteresis control algorithm to operate the HVAC system in a cooling mode while simultaneously operating the auxiliary heat source to provide a dehumidified, temperature-conditioned airflow to a zone conditioned by the HVAC system.

13 Claims, 4 Drawing Sheets

Example of basic ERD operation.

(56) References Cited

U.S. PATENT DOCUMENTS

| | | | | |
|---|---|---|---|---|
| 6,012,296 | A * | 1/2000 | Shah | F24F 11/0008 62/173 |
| 6,070,110 | A * | 5/2000 | Shah | F24F 11/0008 165/205 |
| 6,996,999 | B2 * | 2/2006 | Wacker | F24F 11/0008 165/225 |
| 8,292,192 | B1 * | 10/2012 | Purswell et al. | A01K 41/04 236/44 C |
| 2003/0192331 | A1 * | 10/2003 | Alford | F24F 3/1405 62/173 |
| 2004/0108388 | A1 * | 6/2004 | Wacker | F24F 3/153 236/44 C |
| 2012/0198867 | A1 * | 8/2012 | Ng et al. | F24F 3/14 62/93 |
| 2012/0272669 | A1 * | 11/2012 | Blanton et al. | F25B 5/02 62/89 |
| 2013/0340448 | A1 * | 12/2013 | Puranen | F24F 3/153 62/90 |
| 2015/0096736 | A1 * | 4/2015 | Bronicki et al. | F28F 27/00 165/288 |
| 2015/0280633 | A1 * | 10/2015 | Marohl et al. | H02P 27/085 318/503 |
| 2017/0299202 | A1 | 10/2017 | Hancock | |

* cited by examiner

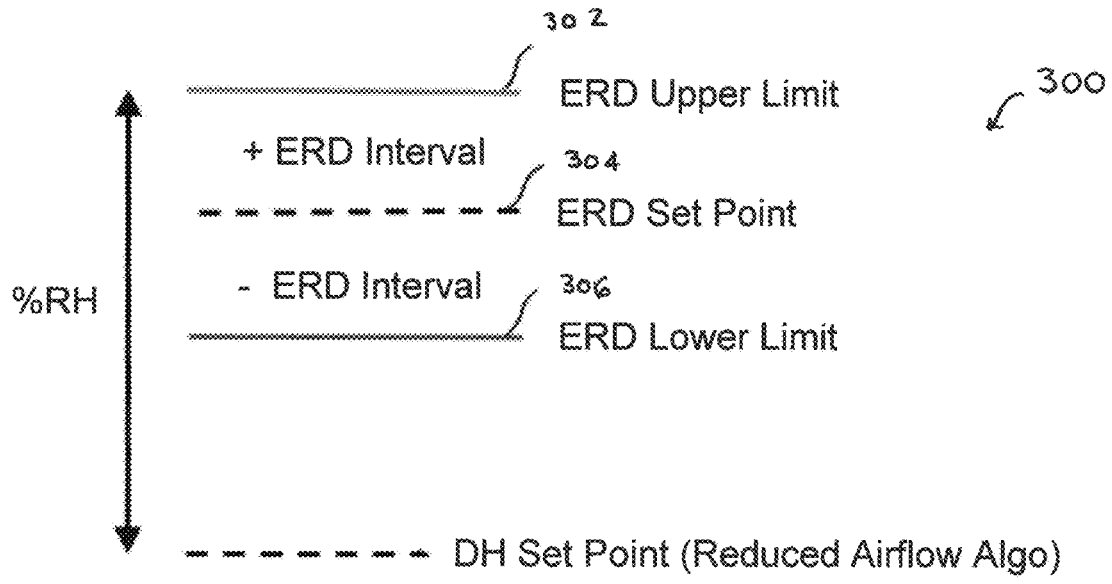
FIG. 3. Diagram of dehumidification set points.
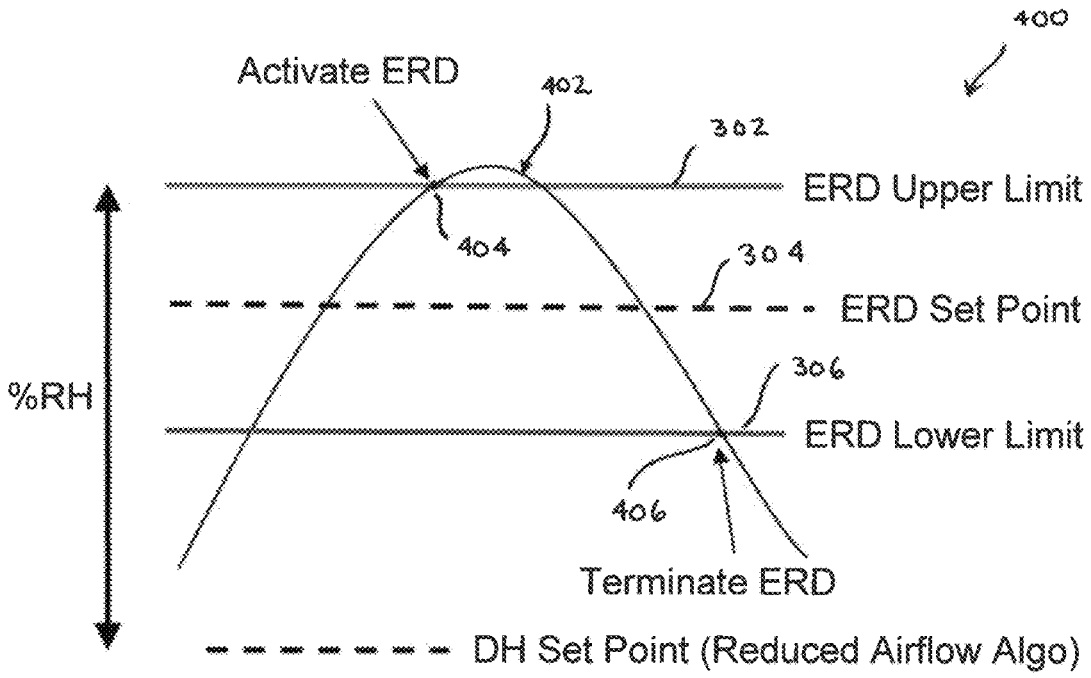
FIG. 4. Example of basic ERD operation.

CONTROL OF RESIDENTIAL HVAC EQUIPMENT FOR DEHUMIDIFICATION

CROSS-REFERENCE TO RELATED APPLICATIONS

The present application claims priority under 35 U.S.C. 119(e) to U.S. Provisional Patent Application No. 62/424,174 filed Nov. 18, 2016 by Wayne Kraft, et al. entitled "Control of Residential HVAC Equipment for Dehumidification," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems may generally be used in residential and/or commercial areas for heating and/or cooling to create comfortable temperatures inside those areas. Some HVAC systems may be split-type heat pump systems that have an indoor air handling unit and an outdoor unit and are capable of cooling a comfort zone by operating in a cooling mode for transferring heat from a comfort zone to an ambient zone using a refrigeration cycle and also generally capable of reversing the direction of refrigerant flow through the components of the HVAC system so that heat is transferred from the ambient zone to the comfort zone, thereby heating the comfort zone. In hot, humid climates, high humidity levels greater than 60% relative humidity (RH) can be common, particularly during a shoulder season under mild outdoor conditions when the HVAC system operates infrequently. However, some HVAC systems lack the ability to dehumidify a comfort zone while providing cooling to the comfort zone without costly dehumidification equipment.

SUMMARY

In some embodiments of the disclosure, a method of operating a heating, ventilation, and/or air conditioning (HVAC) system is disclosed. The method may include detecting, in a zone conditioned by the HVAC system, a humidity level above an electric reheat dehumidification (ERD) set point. The method may further include initiating operation of the HVAC system in an ERD mode responsive to detecting the humidity level above the ERD set point.

In other embodiments of the disclosure, a heating, ventilation, and/or air conditioning (HVAC) system is disclosed. The HVAC system may include a plurality of humidity sensors and a system controller. The system controller may be configured to initiate operation of the HVAC system in an electric reheat dehumidification (ERD) mode in response to receiving a signal indicating that a humidity level in a zone conditioned by the HVAC system is above an ERD set point, the signal being received by a humidity sensor selected from one of the plurality of humidity sensors.

For the purpose of clarity, any one of the embodiments disclosed herein may be combined with any one or more other embodiments disclosed herein to create a new embodiment within the scope of the present disclosure.

BRIEF DESCRIPTION OF THE DRAWINGS

For a more complete understanding of the present disclosure and the advantages thereof, reference is now made to the following brief description, taken in connection with the accompanying drawings and detailed description:

FIG. 3 is a diagram of electric reheat dehumidification (ERD) set points of the HVAC system of FIGS. 1 and 2 according to an embodiment of the disclosure;

FIG. 4 is a diagram of electric reheat dehumidification (ERD) operation of the HVAC system of FIGS. 1 and 2 according to an embodiment of the disclosure.

DETAILED DESCRIPTION

Figure 1:
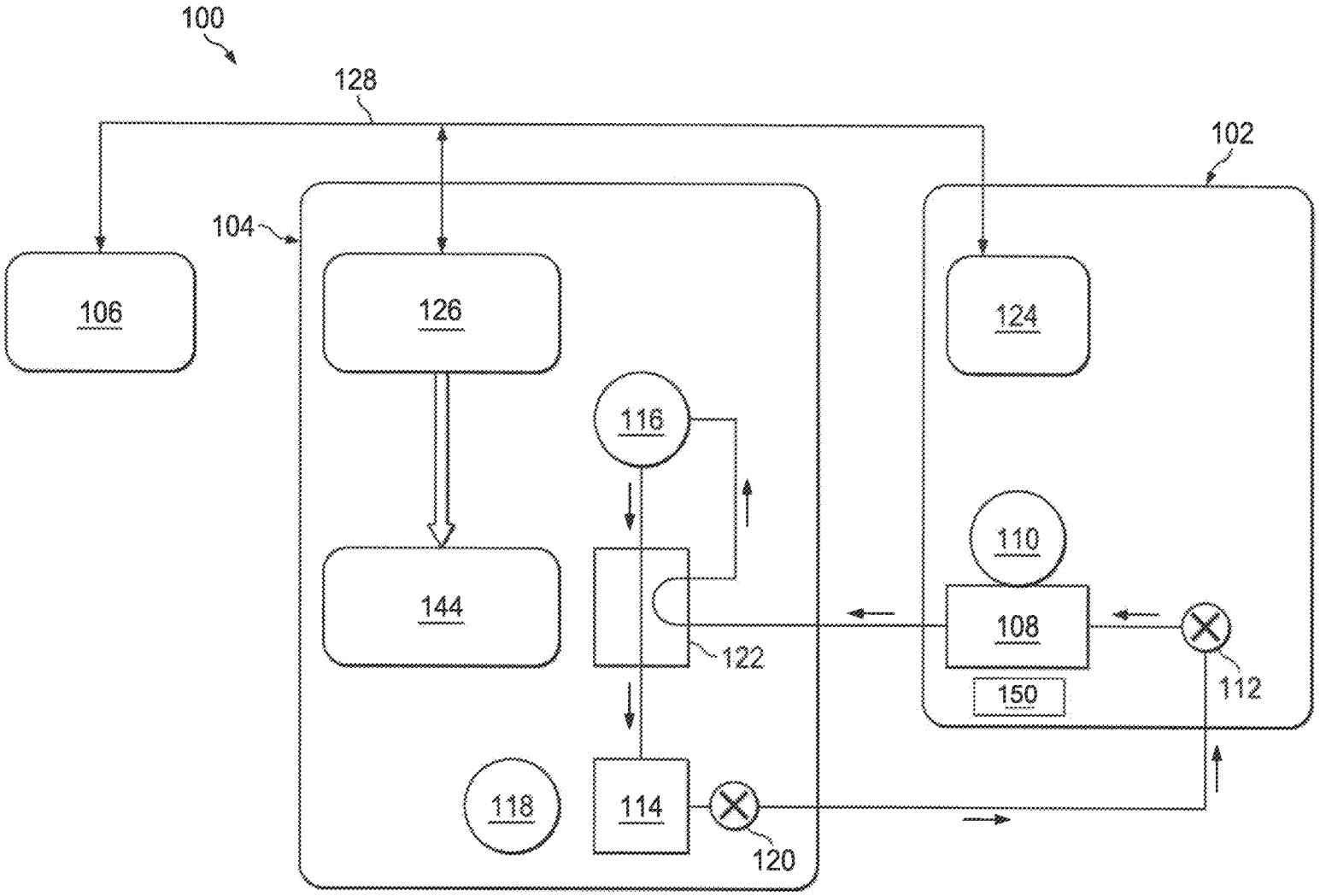
FIG. 1 is a schematic diagram of a heating, ventilation, and/or air conditioning (HVAC) system according to an embodiment of the disclosure.

It should be understood at the outset that although illustrative implementations of one or more embodiments of the present disclosure are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Recent Residential Building Codes have mandated construction practices, which have improved the thermal envelope and therefore energy efficiency of residential buildings. These changes in construction practices have reduced a home's thermal exchange with the outdoor environment, thus reducing the cooling and heating loads on a home. Reduced heating and cooling loads in these High Performance (HP) homes results in reduced operation of HVAC equipment and therefore reduced energy usage. However occupant behavior and required introduction of fresh air into the living spaces may continue to introduce moisture into homes, particularly in hot/humid climates. As a result, the cooling equipment when under mild outdoor temperatures may not be required to operate for extended periods, as it may be unnecessary to maintain a comfortable temperature in the living space. However, moisture loads may remain present and can dominate any unmet load on the home. This unmet moisture load may not be unaddressed by typical HVAC equipment. Therefore in hot, humid climates, high humidity levels (e.g., greater than 60% RH) can be common inside homes such as those built according to these new construction practices, particularly during a shoulder season under mild outdoor conditions when an HVAC system operates infrequently. This may present an increased risk for home owner discomfort and unwanted mold growth in such new homes. To address these and other issues associated with new construction practices, embodiments of the present disclosure include HVAC solutions that provide dehumidification to the living space independent of typical cooling system operation. The disclosed embodiments further include solutions for control of residential HVAC equipment for dehumidification to address issues such as those discussed above, by controlling HVAC equipment in an integrated manner to achieve whole house dehumidification as an additional mode of operation independent of cooling or heating modes. In some embodiments, the disclosed solutions may be accomplished with existing cooling and heating equipment by employing control strategies rather than requiring costly, dedicated dehumidification accessories. As such, the disclosed solutions may offer desirable life cycle costs for home owners, due to the intermittent need for dehumidification operation and the proposed solutions' lower upfront cost when compared to dedicated dehumidification accessories.

Referring now to FIG. 1, a schematic diagram of a heating, ventilation, and/or air conditioning (HVAC) system 100 is shown according to an embodiment of the disclosure. Most generally, HVAC system 100 comprises a heat pump system that may be selectively operated to implement one or more substantially closed thermodynamic refrigeration cycles to provide a cooling functionality (hereinafter "cooling mode") and/or a heating functionality (hereinafter "heating mode"). The HVAC system 100, configured as a heat pump system, generally comprises an indoor unit 102, an outdoor unit 104, and a system controller 106 that may generally control operation of the indoor unit 102 and/or the outdoor unit 104.

Indoor unit 102 generally comprises an indoor air handling unit comprising an indoor heat exchanger 108, an indoor fan 110, an indoor metering device 112, an indoor controller 124, and an auxiliary heat source 150. The indoor heat exchanger 108 may generally be configured to promote heat exchange between refrigerant carried within internal tubing of the indoor heat exchanger 108 and an airflow that may contact the indoor heat exchanger 108 but that is segregated from the refrigerant. In some embodiments, the indoor heat exchanger 108 may comprise a plate-fin heat exchanger. However, in other embodiments, indoor heat exchanger 108 may comprise a microchannel heat exchanger and/or any other suitable type of heat exchanger.

The indoor fan 110 may generally comprise a variable speed blower comprising a blower housing, a blower impeller at least partially disposed within the blower housing, and a blower motor configured to selectively rotate the blower impeller. The indoor fan 110 may generally be configured to provide airflow through the indoor unit 102, the indoor heat exchanger 108, and/or the auxiliary heat source 150 to promote heat transfer between the airflow and a refrigerant flowing through the indoor heat exchanger 108 and/or heating elements of the auxiliary heat source 150. The indoor fan 110 may also be configured to deliver temperature-conditioned air from the indoor unit 102 to one or more areas and/or zones of a climate controlled structure. The indoor fan 110 may generally be configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, however, the indoor fan 110 may be a single speed fan.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device. In some embodiments, while the indoor metering device 112 may be configured to meter the volume and/or flow rate of refrigerant through the indoor metering device 112, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

The auxiliary heat source 150 generally comprises an electric heat source that may be selectively activated by the system controller 106. In general, the auxiliary heat source 150 may be typically activated when the heat pump heating cycle is insufficient or is unavailable. However, the auxiliary heat source 150 may also be activated during a cooling cycle to provide dehumidification. In some embodiments, the auxiliary heat source 150 may comprise a heater assembly that may comprise one or more resistive electrical heat elements (REHE) that are configured to generate heat by converting electrical energy into heat energy. In other embodiments, the auxiliary heat source 150 may comprise a hydronic heat exchanger (HHE) which primarily uses heated or cooled water as a heat transfer medium.

Outdoor unit 104 generally comprises an outdoor heat exchanger 114, a compressor 116, an outdoor fan 118, an outdoor metering device 120, a reversing valve 122, and an outdoor controller 126. In some embodiments, the outdoor unit 104 may also comprise a plurality of temperature sensors for measuring the temperature of the outdoor heat exchanger 114, the compressor 116, and/or the outdoor ambient temperature. The outdoor heat exchanger 114 may generally be configured to promote heat transfer between a refrigerant carried within internal passages of the outdoor heat exchanger 114 and an airflow that contacts the outdoor heat exchanger 114 but that is segregated from the refrigerant. In some embodiments, outdoor heat exchanger 114 may comprise a plate-fin heat exchanger. However, in other embodiments, outdoor heat exchanger 114 may comprise a spine-fin heat exchanger, a microchannel heat exchanger, or any other suitable type of heat exchanger.

The compressor 116 may generally comprise a variable speed scroll-type compressor that may generally be configured to selectively pump refrigerant at a plurality of mass flow rates through the indoor unit 102, the outdoor unit 104, and/or between the indoor unit 102 and the outdoor unit 104. In some embodiments, the compressor 116 may comprise a rotary type compressor configured to selectively pump refrigerant at a plurality of mass flow rates. In alternative embodiments, however, the compressor 116 may comprise a modulating compressor that is capable of operation over a plurality of speed ranges, a reciprocating-type compressor, a single speed compressor, and/or any other suitable refrigerant compressor and/or refrigerant pump. In some embodiments, the compressor 116 may be controlled by a compressor drive controller 144, also referred to as a compressor drive and/or a compressor drive system.

The outdoor fan 118 may generally comprise an axial fan comprising a fan blade assembly and fan motor configured to selectively rotate the fan blade assembly. The outdoor fan 118 may generally be configured to provide airflow through the outdoor unit 104 and/or the outdoor heat exchanger 114 to promote heat transfer between the airflow and a refrigerant flowing through the indoor heat exchanger 108. The outdoor fan 118 may generally be configured as a modulating and/or variable speed fan capable of being operated at a plurality of speeds over a plurality of speed ranges. In other embodiments, the outdoor fan 118 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118. In yet other embodiments, the outdoor fan 118 may be a single speed fan. Further, in other embodiments, however, the outdoor fan 118 may comprise a mixed-flow fan, a centrifugal blower, and/or any other suitable type of fan and/or blower.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device. In some embodiments, while the outdoor metering device 120 may be configured to meter the volume and/or flow rate of refrigerant through the outdoor metering device 120, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

The reversing valve 122 may generally comprise a four-way reversing valve. The reversing valve 122 may also comprise an electrical solenoid, relay, and/or other device configured to selectively move a component of the reversing valve 122 between operational positions to alter the flowpath of refrigerant through the reversing valve 122 and consequently the HVAC system 100. Additionally, the reversing valve 122 may also be selectively controlled by the system controller 106 and/or an outdoor controller 126.

The system controller 106 may generally be configured to selectively communicate with an indoor controller 124 of the indoor unit 102, an outdoor controller 126 of the outdoor unit 104, and/or other components of the HVAC system 100. In some embodiments, the system controller 106 may be configured to control operation of the indoor unit 102 and/or the outdoor unit 104. In some embodiments, the system controller 106 may be configured to monitor and/or communicate with a plurality of temperature sensors associated with components of the indoor unit 102, the outdoor unit 104, and/or the ambient outdoor temperature. Additionally, in some embodiments, the system controller 106 may comprise a temperature sensor and/or a humidity sensor and/or may further be configured to control heating and/or cooling of zones associated with the HVAC system 100. In other embodiments, however, the system controller 106 may be configured as a thermostat for controlling the supply of conditioned air to zones associated with the HVAC system 100.

The system controller 106 may also generally comprise a touchscreen interface for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, however, the system controller 106 may not comprise a display and may derive all information from inputs from remote sensors and remote configuration tools.

In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128.

The indoor controller 124 may be carried by the indoor unit 102 and may generally be configured to receive information inputs, transmit information outputs, and/or otherwise communicate with the system controller 106, the outdoor controller 126, and/or any other device via the communication bus 128 and/or any other suitable medium of communication. In some embodiments, the indoor controller 124 may be configured to receive information related to a speed of the indoor fan 110, transmit a control output to the auxiliary heat source 150, transmit information regarding an indoor fan 110 volumetric flow-rate, communicate with and/or otherwise affect control over an air cleaner, and communicate with an indoor EEV controller. In some embodiments, the indoor controller 124 may be configured to communicate with an indoor fan 110 controller and/or otherwise affect control over operation of the indoor fan 110.

The outdoor controller 126 may be carried by the outdoor unit 104 and may be configured to receive information inputs, transmit information outputs, and/or otherwise communicate with the system controller 106, the indoor controller 124, and/or any other device via the communication bus 128 and/or any other suitable medium of communication. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the compressor 116, the outdoor fan 118, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with and/or control a compressor drive controller 144 that is configured to electrically power and/or control the compressor 116.

The HVAC system 100 is shown configured for operating in a so-called cooling mode in which heat is absorbed by refrigerant at the indoor heat exchanger 108 and heat is rejected from the refrigerant at the outdoor heat exchanger 114. In some embodiments, the compressor 116 may be operated to compress refrigerant and pump the relatively high temperature and high pressure compressed refrigerant from the compressor 116 to the outdoor heat exchanger 114 through the reversing valve 122 and to the outdoor heat exchanger 114. As the refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114. The refrigerant may primarily comprise liquid phase refrigerant and the refrigerant may flow from the outdoor heat exchanger 114 to the indoor metering device 112 through and/or around the outdoor metering device 120 which does not substantially impede flow of the refrigerant in the cooling mode. The indoor metering device 112 may meter passage of the refrigerant through the indoor metering device 112 so that the refrigerant downstream of the indoor metering device 112 is at a lower pressure than the refrigerant upstream of the indoor metering device 112. The pressure differential across the indoor metering device 112 allows the refrigerant downstream of the indoor metering device 112 to expand and/or at least partially convert to a two-phase (vapor and gas) mixture. The two-phase refrigerant may enter the indoor heat exchanger 108. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108, and causing evaporation of the liquid portion of the two-phase mixture. The refrigerant may thereafter re-enter the compressor 116 after passing through the reversing valve 122.

To operate the HVAC system 100 in the so-called heating mode, the reversing valve 122 may be controlled to alter the flow path of the refrigerant, the indoor metering device 112 may be disabled and/or bypassed, and the outdoor metering device 120 may be enabled. In the heating mode, refrigerant may flow from the compressor 116 to the indoor heat exchanger 108 through the reversing valve 122, the refrigerant may be substantially unaffected by the indoor metering device 112, the refrigerant may experience a pressure differential across the outdoor metering device 120, the refrigerant may pass through the outdoor heat exchanger 114, and the refrigerant may re-enter the compressor 116 after passing through the reversing valve 122. Most generally, operation of the HVAC system 100 in the heating mode reverses the roles of the indoor heat exchanger 108 and the outdoor heat exchanger 114 as compared to their operation in the cooling mode.

Figure 2:
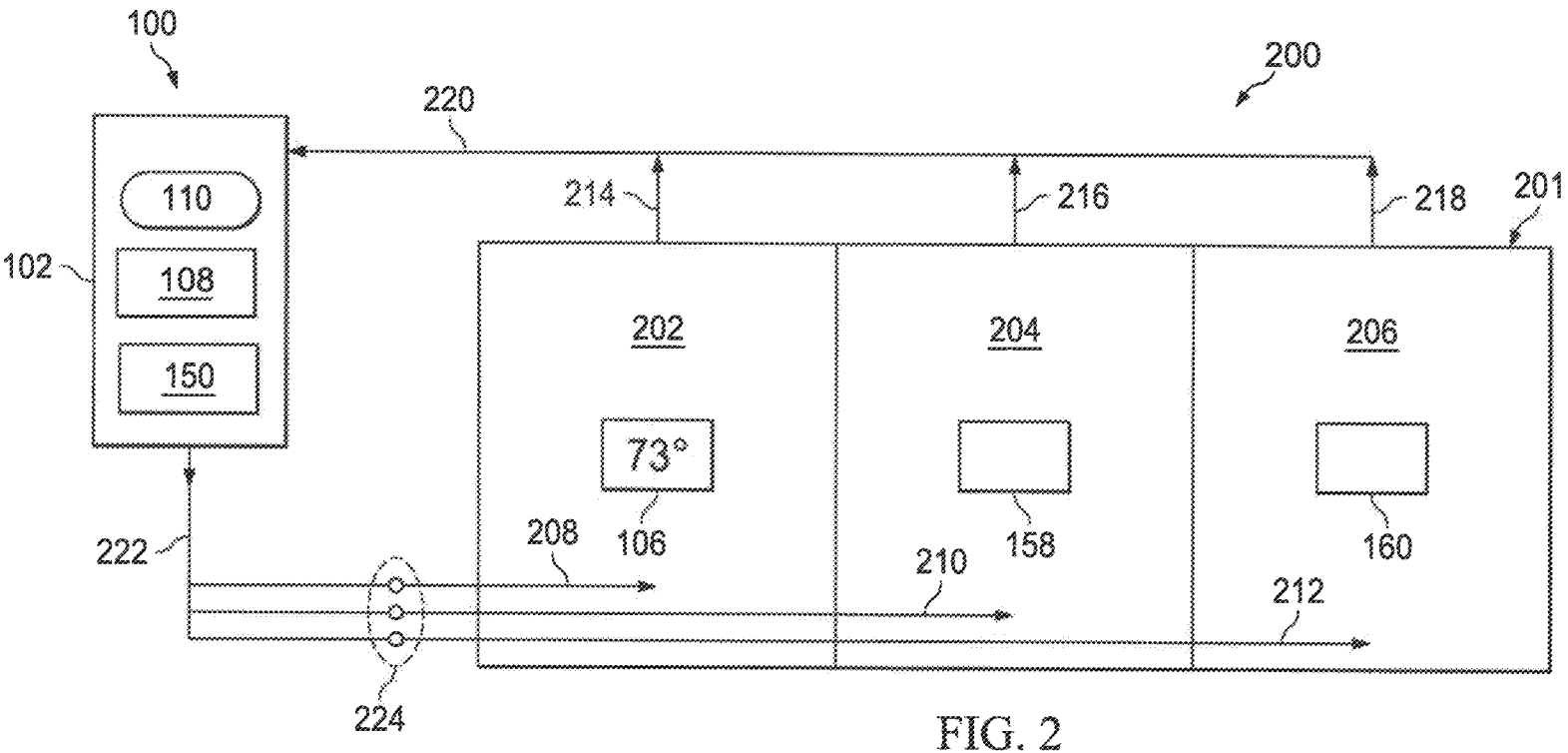
FIG. 2 is a schematic diagram of an air circulation path of the HVAC system of FIG. 1 according to an embodiment of the disclosure.

Referring now to FIG. 2, a schematic diagram of an air circulation path 200 of the HVAC system 100 of FIG. 1 is shown according to an embodiment of the disclosure. The HVAC system 100 of FIG. 1 may generally comprise an indoor fan 110 configured to circulate and/or condition air of a plurality of zones 202, 204, 206 of a structure 201. It will be appreciated that while three zones 202, 204, 206 are shown, any number of zones may be present in the structure 201. The air circulation path 200 of the HVAC system 100 may generally comprise a first zone supply duct 208, a second zone supply duct 210, a third zone supply duct 212, a first zone return duct 214, a second zone return duct 216, a third zone return duct 218, a main return duct 220, a main supply duct 222, a plurality of zone dampers 224, and an indoor unit 102 comprising an indoor heat exchanger 108, an indoor fan 110, and an auxiliary heat source 150.

Additionally, the HVAC system 100 may further comprise a zone thermostat 158 and a zone sensor 160. In some embodiments, a zone thermostat 158 may communicate with the system controller 106 and may allow a user to control a temperature setting, a humidity setting, and/or other environmental setting for the zone 202, 204, 206 in which the zone thermostat 158 is located. Further, the zone thermostat 158 may communicate with the system controller 106 to provide temperature, humidity, and/or other environmental feedback regarding the zone 202, 204, 206 in which the zone thermostat 158 is located. In some embodiments, a zone sensor 160 may also communicate with the system controller 106 to provide temperature, humidity, and/or other environmental feedback regarding the zone 202, 204, 206 in which the zone sensor 160 is located. Further, although only one zone thermostat 158 and one zone sensor 160 are shown, each of the zones 202, 204, 206 may comprise a zone thermostat 158 and/or a zone sensor 160.

The system controller 106 may be configured for bidirectional communication with any zone thermostat 158 and/or zone sensor 160 so that a user may, using the system controller 106, monitor and/or control any of the HVAC system 100 components regardless of which zones 202, 204, 206 the zone thermostat 158 and/or zone sensor 160 may be associated. Further, each system controller 106, each zone thermostat 158, and each zone sensor 160 may comprise a temperature sensor and/or a humidity sensor. As such, it will be appreciated that structure 201 is equipped with a plurality of temperature sensors and/or humidity sensors in the plurality of different zones 202, 204, 206. In some embodiments, a user may effectively select which of the plurality of temperature sensors and/or humidity sensors is used to control operation of the HVAC system 100. Thus, when at least one of the system controller 106, the zone thermostat 158, and the zone sensor 160 determines that a temperature and/or humidity of an associated zone has fallen outside either the temperature setting or the humidity setting, respectively, the system controller 106 may operate the HVAC system 100 in either the cooling mode or the heating mode to provide temperature conditioned air to at least one of the zones 202, 204, 206 and may also activate the auxiliary heat source 150 to provide dehumidification while operating in each of the cooling mode and the heating mode.

In operation, the indoor fan 110 may be configured to generate an airflow through the indoor unit 102 to deliver temperature conditioned air from an air supply opening in the indoor unit 102, through the main supply duct 222, and to each of the plurality of zones 202, 204, 206 through each of the first zone supply duct 208, the second zone supply duct 210, and the third zone supply duct 212, respectively. Additionally, each of the first zone supply duct 208, the second zone supply duct 210, and the third zone supply duct 212 may comprise a zone damper 224 that regulates the airflow to each of the zones 202, 204, 206. In some embodiments, the zone dampers 224 may regulate the flow to each zone 202, 204, 206 in response to a temperature or humidity sensed by at least one temperature sensor and/or humidity sensor carried by at least one of the system controller 106, the zone thermostat 158, and the zone sensor 160.

Air from each zone 202, 204, 206 may return to the main return duct 220 through each of the first zone return duct 214, the second zone return duct 216, and the third zone return duct 218. From the main return duct 220, air may return to the indoor unit 102 through an air return opening in the indoor unit 102. Air entering the indoor unit 102 through the air return opening may then be conditioned for delivery to each of the plurality of zones 202, 204, 206 as described above. Circulation of the air in this manner may continue repetitively until the temperature and/or humidity of the air within the zones 202, 204, 206 conforms to a target temperature and/or a target humidity as required by at least one of the system controller 106, the zone thermostat 158, and/or the zone sensor 160.

Control of residential HVAC equipment for dehumidification may integrate dehumidification strategies for operating HVAC equipment via the system controller 106, in an independent "dehumidification" mode, i.e., independent of existing heating and cooling operating modes. The independent dehumidification mode may allow the HVAC equipment to uniquely meet the moisture loads in homes when there is insufficient cooling load to demand operation of the cooling equipment. This may occur more frequently in homes built according to recent Building Codes with energy efficient construction practices, where home occupants may observe discomfort and risk of mold occurrence. To address such issues, embodiments of the disclosure may specifically target humidity control, independent of cooling and heating operation of the HVAC equipment. To achieve the dehumidification mode, the system controller 106 may operate the HVAC system 100 using electric reheat dehumidification (ERD), e.g., when high humidity levels are observed. ERD operation may remove moisture from the air in the living space, while providing negligible changes to the space temperature. Additionally, indoor equipment airflow rate during ERD operation may be generally reduced from nominal cooling mode operation to increase the rate at which moisture is removed from the air.

In coordination with the independent "dehumidification" mode and ERD function, HVAC system controller strategies may be integrated to limit operation and energy usage for the dehumidification mode to only what is minimally desired or necessary. Such strategies may include coordinating humidity limits (e.g., % RH) during cooling mode and dehumidification mode for ERD. Achieving dehumidification during cooling mode operation may be preferred from an energy usage perspective when compared to ERD operation. However, the HVAC system 100 may not operate frequently in cooling mode during relatively high humidity periods (e.g., greater than 60% RH) with mild outdoor temperatures. Therefore, humidity limits for enhancing dehumidification capability during cooling mode operation may be enforced to lower humidity levels than ERD humidity limits. This may create a staging of dehumidification solutions within the system controller 106. More efficient dehumidification achieved during cooling operation may be maximized when possible. Therefore, the system controller 106 may be configured to maintain the living space to lower humidity levels during cooling mode operation when it is able to operate. In scenarios where the system controller 106 may not be able to maintain the humidity level due to infrequent operation of the cooling mode, the humidity in the living space may increase until the higher ERD humidity limits are reached, resulting in dehumidification mode operation. The independent dehumidification mode with ERD operation may effectively become a backup dehumidification method to prevent humidity from uncontrollably increasing to unacceptable levels. This intentional, staged pairing of the dehumidification strategies within the system controller may limit operation of the independent dehumidification mode to only periods of high humidity, thus limiting energy usage by maximizing the opportunity for the more efficient cooling mode to provide dehumidification when cooling mode does operate. Additionally, limits on dehumidification mode operation may be explicitly placed on the available operation time of the mode to prevent excessive operation, while also limiting energy usage. In environments where humidity levels are high and demand dehumidification mode operation, fan-only operation of the indoor air handling equipment (e.g., circulating fan, continuous fan, blower interlocks with accessories) may be prevented to avoid evaporation of moisture back into the living space that was previously removed, but still retained on the surface of the indoor heat exchanger 108. The system controller 106 may coordinate these actions with the independent dehumidification mode to provide effective control of HVAC equipment for dehumidification while limiting additional energy usage to provide humidity comfort with attractive life cycle costs.

Still referring to FIG. 2, the HVAC system 100 may also be configured to provide electric reheat dehumidification (ERD) to adjust and/or control a humidity of the circulating air of HVAC system 100. Generally, the HVAC system 100 may be operated by the system controller 106 to provide ERD to the zones 202, 204, 206 by operating the HVAC system 100 in the cooling mode while simultaneously operating the auxiliary heat source 150 to deliver temperature conditioned air from the indoor unit 102 to the plurality of zones 202, 204, 206. It will be appreciated that the auxiliary heat source 150 is disposed within the and/or installed in the indoor unit 102 of HVAC system 100 such that substantially all of the entirety of the airflow delivered to each of the plurality of zones 202, 204, 206 through the main supply duct 222 passes through the auxiliary heat source 150 to provide "whole-house" dehumidification to the plurality of zones 202, 204, 206 of the structure 201. However, in some embodiments, the zone dampers 224 may be operated to control the flow of the temperature conditioned air to zones 202, 204, 206 based on the demand for dehumidification in any one of the zones 202, 204, 206.

Referring now to FIG. 3, a diagram 300 of electric reheat dehumidification (ERD) set points of the HVAC system 100 of FIGS. 1-2 is shown according to an embodiment of the disclosure. As shown in FIG. 3, the ERD set points may generally comprise an ERD upper limit 302, an ERD set point 304, and an ERD lower limit 306 that each may be received via a user interface of the system controller 106. In some embodiments, a cooling mode dehumidification set point may also be stored in the system controller 106. The cooling mode dehumidification set point may generally comprise a humidity set point at which a standard dehumidification event would occur. However, it will be appreciated that the ERD set point 304 may generally be higher than the cooling mode dehumidification set point. Thus, in some embodiments, the ERD set point 304 may be about 3% higher, about 5% higher, and/or about 10% higher than the dehumidification set point. The ERD upper limit 302 may be defined by a positive ERD interval with respect to the ERD set point 304. Accordingly, in some embodiments, the ERD upper limit 302 may comprise about a (+1%), about a (+2%), about a (+3%), and/or about a (+5%) relative humidity setting as compared to the ERD set point 304. Similarly, the ERD lower limit 306 may be defined by a negative ERD interval with respect to the ERD set point 304. Accordingly, in some embodiments, the ERD lower limit 306 may comprise about a (−1%), about a (−2%), about a (−3%), and/or about a (−5%) relative humidity setting as compared to the ERD set point 304. However, any interval may be established between the ERD upper limit 302 and the ERD set point 304, and the ERD lower limit 306 and the ERD set point 304 based on any number of factors, including, but not limited to, the comfort settings and/or preferences of a user and/or the specifications of the HVAC system 100 equipment.

Referring now to FIG. 4, a diagram 400 of electric reheat dehumidification (ERD) operation of the HVAC system 100 of FIGS. 1-2 is shown according to an embodiment of the disclosure. The system controller 106 may initiate ERD operation of the HVAC system 100 when at least one of the system controller 106, the zone thermostat 158, and the zone sensor 160 determines that the relative humidity of an associated zone 202, 204, 206 has escalated beyond the cooling mode dehumidification set point and/or the ERD set point 304. More specifically, the system controller 106 may employ a hysteresis control algorithm having a hysteresis band 402 that may be stored in either of the system controller 106 and/or indoor controller 124 to activate ERD operation of the HVAC system 100 when the measured relative humidity of a zone 202, 204, 206 exceeds the ERD upper limit 302 as shown at activation point 404. Accordingly, the system controller 106 will configure the HVAC system 100 in the cooling mode such that heat may be absorbed from the airflow generated by the indoor fan 110 by a refrigerant passing through the indoor heat exchanger 108, thereby cooling and removing moisture from the airflow passing through the indoor unit 102. Additionally, however, the auxiliary heat source 150 may be simultaneously activated and/or operated to provide additional heat to the airflow passing across and/or into contact with the auxiliary heat source 150 and through the indoor unit 102 to provide a temperature conditioned and dehumidified airflow to a zone 202, 204, 206 of the structure 201. Additionally, a speed of the indoor fan 110 may also be controlled to provide a target airflow rate in conjunction with the heat added from the auxiliary heat source 150 to provide a dehumidified, yet temperature conditioned, airflow into a zone 202, 204, 206 of the structure 201. Thus, in some embodiments, ERD operation of the HVAC system 100 may provide substantially negligible sensible heat ratios that remain substantially near zero. Operation of the HVAC system 100 in the ERD mode of operation will continue until the measured relative humidity of the zone 202, 204, 206 requiring activation of the ERD mode of operation meets and/or drops below the ERD lower limit 306 as shown at deactivation point 406.

During ERD operation of the HVAC system 100, the auxiliary heat source 150 may be operated substantially constantly. However, in other embodiments, the auxiliary heat source 150 may be duty cycled on and off to provide dehumidification to the airflow without overheating the airflow. This may be particularly effective when the auxiliary heat source 150 is oversized with respect to the heating needs of the ERD operation. Alternatively, the auxiliary heat source 150 may comprise a plurality of heating elements that may be operated in a staged sequence to provide an increasing and/or decreasing amount of heat based on the relative humidity measured in a zone 202, 204, 206. Additionally, it will be appreciated that ERD operation of the HVAC system 100 may use dew point for control instead of relative humidity. Further, in some embodiments, the hysteresis control algorithm may comprise a symmetric hysteresis band 402 having substantially similar intervals between the ERD set point 304 and each of the ERD upper limit 302 and the ERD lower limit 306. However, in other embodiments, the hysteresis control algorithm may comprise an asymmetric hysteresis band 402 having substantially different intervals (unique positive and negative ERD values) between the ERD set point 304 and each of the ERD upper limit 302 and the ERD lower limit 306.

ERD operation may generally be decoupled from other modes of operation of the HVAC system 100. Accordingly, ERD operation may be a mode employed substantially similarly and substantially independently from other modes of operation of the HVAC system 100 such as the heating mode and the cooling mode. As such, ERD operation may comprise its own parameters, yet minimum on/off times associated with a normal heating mode and/or a normal cooling mode still apply to ERD operation. In other words, ERD operation may be terminated after a predetermined duration. For example, ERD operation may be activated during conditions in which the HVAC system 100 detects relatively high humidity levels (e.g., if RH exceeds an ERD set point, humidity limit, etc.). However, if the HVAC system 100 employs humidity sensors that respond relatively slowly, it may be useful to terminate ERD operation after a certain time period (e.g., depending on the humidity levels and/or the response times of the humidity sensors).

Furthermore, when the system controller 106 recognizes a demand for operating the HVAC system 100 in a heating mode or a cooling mode, the demand for heating or cooling based on temperature takes precedence over demands for ERD operation. Accordingly, ERD operation of the HVAC system 100 may be overridden and/or terminated by a demand for heating or cooling. In some embodiments, ERD operation may be terminated after a predetermined duration. For example, ERD operation may be activated during conditions in which the HVAC system detects relatively high humidity levels (e.g., if RH exceeds an ERD set point). However, if the HVAC system 100 employs humidity sensors that respond relatively slowly, it may be useful to terminate ERD operation after a certain time period (e.g., depending on the humidity levels and/or the response times of the humidity sensors).

Furthermore, if the HVAC system 100 is operating in a heating mode or a cooling mode and the system controller 106 recognizes a need for ERD operation, the HVAC system 100 will continue operating in the heating mode or the cooling mode until a temperature set point is met. Then, the HVAC system 100 may transition to ERD operation. While systems and methods are disclosed herein in relation to HVAC system 100, it will be appreciated that this disclosure contemplates that any air conditioning system operable in a cooling mode may be retrofit with a system capable of ERD operation by integrating an auxiliary heat source, such as auxiliary heat source 150 into an existing air handler. Further, an application specific integrated circuit (ASIC) and/or software may be installed and/or integrated into an existing system and or other controller.

Figure 5:
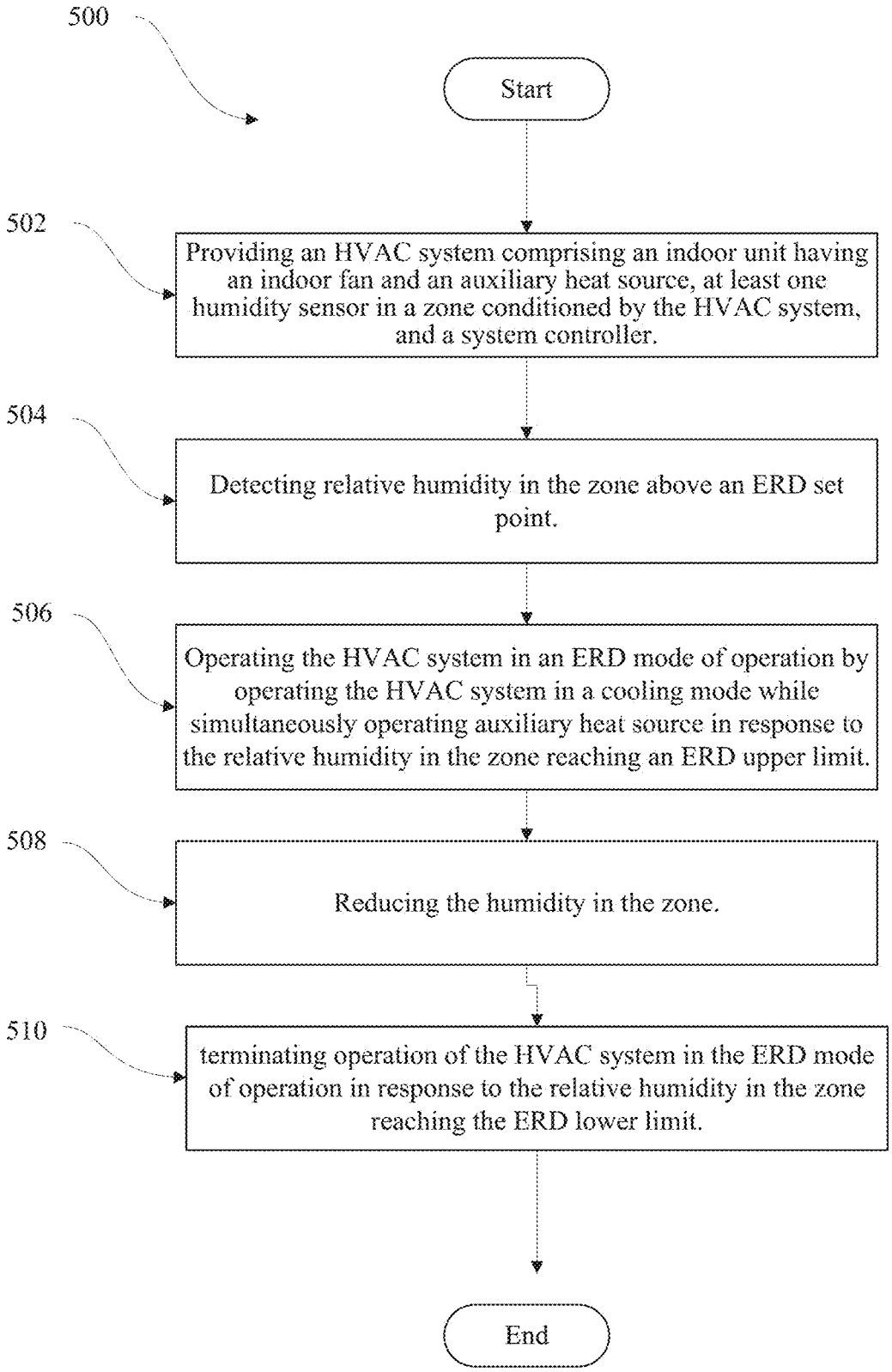
FIG. 5 is a flowchart of a method of operating the HVAC system of FIGS. 1-2 according to an embodiment of the disclosure.

Referring now to FIG. 5, a flowchart of a method 500 of operating the HVAC system 100 of FIGS. 1-2 is shown according to an embodiment of the disclosure. The method 500 may begin at block 502 by providing an HVAC system comprising an indoor unit having an indoor fan and an auxiliary heat source, at least one humidity sensor in a zone conditioned by the HVAC system, and a system controller. The method 500 may continue at block 504 by detecting relative humidity in the zone above an ERD set point. The method 500 may continue at block 506 by operating the HVAC system in an ERD mode of operation by operating the HVAC system in a cooling mode while simultaneously operating auxiliary heat source in response to the relative humidity in the zone reaching an ERD upper limit. In some embodiments, the ERD upper limit may comprise a positive relative humidity above the ERD set point. The method 500 may continue at block 508 by reducing the humidity in the zone. The method may continue at block 510 by terminating operation of the HVAC system in the ERD mode of operation in response to the relative humidity in the zone reaching an ERD lower limit. In some embodiments, the ERD lower limit may comprise a negative relative humidity below the ERD set point.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heating, ventilation, and air conditioning (HVAC) system, the HVAC system comprising:

at least one humidity sensor;

a heat exchanger configured to absorb heat;

an auxiliary heat source comprising one or more resistive electrical heat elements configured to generate heat by converting electrical energy into heat energy; and a system controller configured to:

when a cooling demand signal is received, initiate operation of the HVAC system in a cooling mode, wherein the HVAC system in cooling mode is configured to seek to achieve a cooling mode dehumidification set point while absorbing heat with the heat exchanger;

when the cooling demand signal is not received, initiate operation of the HVAC system in an electric reheat dehumidification (ERD) mode in response to receiving a first signal indicating that a humidity level in a zone conditioned by the HVAC system has reached or exceeded an ERD upper limit, wherein the first signal is received from the humidity sensor, wherein the ERD upper limit represents a first preset relative humidity value, wherein ERD mode comprises absorbing heat with the heat exchanger while also generating heat with the auxiliary heat source; and terminate operation of the HVAC system in the ERD mode before the humidity level in the zone reaches the cooling mode dehumidification set point, wherein the cooling mode dehumidification set point represents a second preset relative humidity value, wherein the cooling mode dehumidification set point is less than the ERD upper limit such that the system controller is configured to maintain the living space to lower humidity levels during cooling mode operation than during ERD mode operation, thereby limiting operation of the ERD mode.

2. The HVAC system of claim 1, wherein the ERD mode operates independently from a heating mode of the HVAC system.

3. The HVAC system of claim 1, further comprising a plurality of temperature sensors, wherein the system controller is configured to terminate operation of the HVAC system in the ERD mode in response to receiving the cooling demand signal or a heating demand signal.

4. The HVAC system of claim 1, wherein the system controller is configured to selectively activate and deactivate operation of the auxiliary heat source during operation of the HVAC system in the ERD mode.

5. The HVAC system of claim 1, wherein the system controller is configured to operate the ERD mode based on a hysteresis control algorithm.

6. The HVAC system of claim 5, wherein the hysteresis control algorithm comprises one of:

a symmetric hysteresis band having substantially similar intervals between an ERD set point and each of the ERD upper limit and an ERD lower limit; or an asymmetric hysteresis band having substantially different intervals between the ERD set point and each of the ERD upper limit and the ERD lower limit.

7. The HVAC system of claim 1, wherein the system controller is configured to terminate operation of the HVAC system in the ERD mode in response to a time of operating the ERD mode exceeding a predetermined duration, wherein the time of operating the ERD mode is selected such that the humidity level in the zone is not reduced below the cooling mode dehumidification set point.

8. The HVAC system of claim 1, wherein the system controller is configured to terminate operation of the HVAC system in the ERD mode based on a response time of the at least one humidity sensor.

9. The HVAC system of claim 1, further comprising a memory coupled to the system controller and configured to store the cooling mode dehumidification set point and the ERD upper limit.

10. The HVAC system of claim 1, further comprising a memory coupled to the system controller and configured to store the cooling mode dehumidification set point, an ERD lower limit, an ERD set point, and the ERD upper limit, and wherein the cooling mode dehumidification set point is less than the ERD set point, and wherein the ERD set point is less than the ERD upper limit.

11. The HVAC system of claim 1, wherein the system controller receives an input for the ERD upper limit, wherein the HVAC system further comprises a memory coupled to the system controller and configured to store the ERD upper limit.

12. The HVAC system of claim 1, wherein the one or more resistive electrical heat elements are operated in staged sequence to provide an increasing or decreasing amount of heat to an airflow based on the humidity.

13. The HVAC system of claim 1, wherein the system controller is further configured to receive, from a user, a selection of the at least one humidity sensor.

* * * * *